US006810808B1

(12) United States Patent
Wallace et al.

(10) Patent No.: US 6,810,808 B1
(45) Date of Patent: Nov. 2, 2004

(54) PLATE CYLINDER WITH REGISTER PIN ADJUSTMENT DEVICE AND METHOD OF AXIALLY ADJUSTING PRINTING PLATE

(75) Inventors: Eric M. Wallace, Pittsfield, NH (US); Lev Zlatin, Portsmouth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/453,419

(22) Filed: Jun. 2, 2003

(51) Int. Cl.[7] ..... B41F 27/12
(52) U.S. Cl. ..... 101/481; 101/415.1; 101/485
(58) Field of Search ..... 101/415.1, 481, 101/485, 486, DIG. 36, 378, 382.1, 383, 384

(56) References Cited

U.S. PATENT DOCUMENTS

| | | | | |
|---|---|---|---|---|
| 4,748,911 A | | 6/1988 | Kobler | 101/378 |
| 5,327,832 A | * | 7/1994 | Fischer | 101/415.1 |
| 5,379,694 A | | 1/1995 | Haek et al. | 101/415.1 |
| 5,419,248 A | | 5/1995 | Brotzman | 101/378 |
| 6,382,103 B1 | | 5/2002 | Rauh | 101/415.1 |
| 6,439,117 B1 | | 8/2002 | Dumais et al. | 101/383 |
| 6,443,065 B1 | | 9/2002 | Charette et al. | 101/415.1 |
| 2003/0101886 A1 | * | 6/2003 | Rauh | 101/415.1 |

* cited by examiner

*Primary Examiner*—Leslie J. Evanisko
(74) *Attorney, Agent, or Firm*—Davidson, Davidson & Kappel, LLC

(57) ABSTRACT

A register device for insertion into a channel of a printing unit cylinder. The device includes a rod defining an axial direction and a pin support movable in the axial direction by the rod, the rod being movable with respect to the pin support in a direction perpendicular to the axial direction. A register pin is attached to the pin support. Also provided is a register device with a pin support, a register pin and shims for altering the position of the register pin on the pin support.

24 Claims, 5 Drawing Sheets

PLATE CYLINDER WITH REGISTER PIN ADJUSTMENT DEVICE AND METHOD OF AXIALLY ADJUSTING PRINTING PLATE

BACKGROUND INFORMATION

The present invention is directed generally to printing presses and more particularly to a plate cylinder of a printing press, to a register pin adjustment device and to a method for adjusting a register pin.

U.S. Pat. No. 6,382,103 discloses a lateral registration device for printing plates in a plate cylinder, using axially shiftable insertion strips. The strips have register pins which engage recesses in beveled end of the flexible printing plates. Each register pin is fixedly connected to an insertion strip or made of one piece with it.

U.S. Pat. No. 5,419,248 discloses a device for aligning printing plates on a plate cylinder. A plurality of adjustment elements spaced apart from one another are located in a bore. The adjustable elements have moveable register pins thereon. Each adjustment element is fixed to the bore by turning a spreading screw, which spread wings of the adjustment element to wedge the adjustment element in the bore to provide a course adjustment. For fine adjustment, a threaded screw is rotated to move the register pin relative to the adjustment element. An actuating rod for tensioning elements does not move the adjustable elements.

U.S. Pat. Nos. 4,748,911 and 5,379,694 disclose other later register adjustment devices.

BRIEF SUMMARY OF THE INVENTION

An object of the present invention is to reduce the manufacturing tolerances necessary for a register device. An alternate or additional object of the present invention is to provide a register device which is easy to install.

The present invention provides a register device for insertion into a channel of a printing unit cylinder. The device includes a rod defining an axial direction and a pin support movable in the axial direction by the rod, the rod being movable with respect to the pin support in a direction perpendicular to the axial direction. A register pin is attached to the pin support.

The pin support generally slides in axially in the channel with little or no clearance. By permitting the rod to move in the axial direction with respect to the pin support, the register device is easy to install and manufacturing tolerances, including those for the channel, may be reduced.

The rod may be movable in the axial direction with respect to the pin support, for example, by providing a hole in the pin support, with the pin support receiving the rod with a clearance in the hole.

The rod provides for fine adjustment of the register pin in the axial direction.

It may also be desirable to provide a coarse adjustment, for example for different web widths. The pin support thus may be adjustable with respect to the rod when removed from the machine, for example by placing holding bolts in different axial locations along the rod. Alternately, rods of different length could be used to provide this course adjustment.

The register device may include a second rod, a second pin support and a second register pin, or as many register pins as necessary.

When the register device is installed, the rod may move the register pins axially, and the pin support is generally axially fixed with respect to the rod. However, to aid in permitting the movement of the pin support in the direction perpendicular to the axial direction, and the pin support may be attached to the rod so that the pin support can move in the axial direction with respect to the rod by a movement amount, the movement amount being less than 0.1 millimeters. This amount generally will not adversely affect print quality, depending on the type of print job.

The present invention also provides a register device for insertion into a channel of a printing unit cylinder having a rod defining an axial direction, a pin support movable in the axial direction by the rod, a shim replaceably connected to the pin support, and a register pin supported on the shim.

By having a replaceable shim, the thickness of the shim can be adjusted so that the register pin is located at the proper distance from the pin support. This permits the register pin to fit into the slot in the plate cylinder so that the register pin and the pin support slide axially with ease through the channel. Ease of installation can be increased, as can manufacturing tolerances.

The present invention also provides a plate cylinder having a channel for receiving the register devices, as well as a method for adjusting the axial registration of a printing plate using the devices.

The present invention also provides a method for installing a register device in a channel and a slot of a printing unit cylinder comprising the steps of: placing a pin support having a register pin in the channel so that the register pin extends into the slot; determining if the pin support and the register pin slide axially in the channel; and if the pin support and register pin do not slide axially in the channel, placing a shim between the register pin and the pin support.

BRIEF DESCRIPTION OF THE DRAWINGS

The present invention will be described with respect to a preferred embodiment in which.

DETAILED DESCRIPTION

Figure 1:
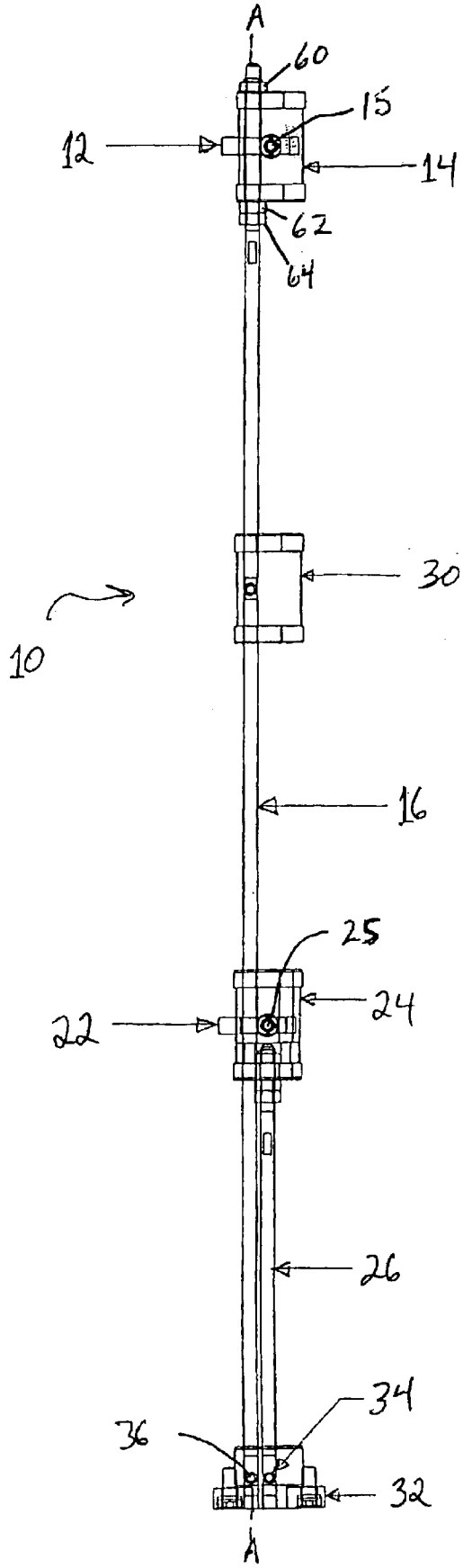
FIG. 1 shows a register device of the present invention with two register pins.

FIG. 1 shows a register device 10 according to the present invention for two register pins 12 and 22. Register pins 12 and 22 each provide axial, also known as lateral, registration for a printing plate on a plate cylinder. Register pin 12 is fixed prior to installation of device 10 via a connector 15 to a register pin support 14, and register pin 22 is fixed to a register pin support 24 by a connector 25. Register pin supports 14, 24 may be made of metal, for example stainless steel, and may be cylindrical to fit slidingly in a channel of a plate cylinder with little or no clearance in the channel.

A rod 16 has an axis A-A defining an axial direction. Rod 16 may pass through an eccentric hole in register pin support 14. The hole has an inside circumference with a diameter larger than the diameter of the outer circumference of the rod 16, so that register pin support 14 can move in a direction perpendicular to the axial direction. Prior to installation of device 10 in a plate cylinder, the axial location of pin support 14 on rod 16 can be set via nuts 60, 62, which are threadedly attached to rod 16. A lock nut 64 can be provided for one or both nuts 60, 62. Due to the clearance between the hole in the pin support 14 and the rod 16, the rods 16 can float in the direction perpendicular to the axial direction with respect to the pin support 14. The device 10 thus can be installed with ease even if the channel is not perfectly bored.

When the device 10 is installed, register pin 12, pin support 14 and rod 16 can move axially together. To adjust the axial location of pin 12, an external plate register tool such as that disclosed in U.S. Pat. No. 6,443,065, the entire disclosure of which is hereby incorporated by reference herein, may be used. A fixing device 36 of a locking end cap 32 then may fix the axial location of rod 16 and thus set the axial registration for register pin 12. Other devices for moving pin 12 and/or rod 16 however may be used.

If a more course adjustment for the register location of pin 12 is desired, for example for a different printing plate width or web width, a different length rod 16 may be used, or if rod 16 is properly sized and so threaded, nuts 60, 62 may be moved to a new location on rod 16.

A second rod 26 is used for adjustment of register pin 22 and pin support 24. As shown, rod 26 need not extend fully through the pin support 24. Rod 16 passes with a clearance through pin support 24. The axial position of pin 22 may be fixed by a second fixing device 34.

A support slide 30 may be provided to and fixed to rod 16 to provide extra support for rod 16.

Figure 2:
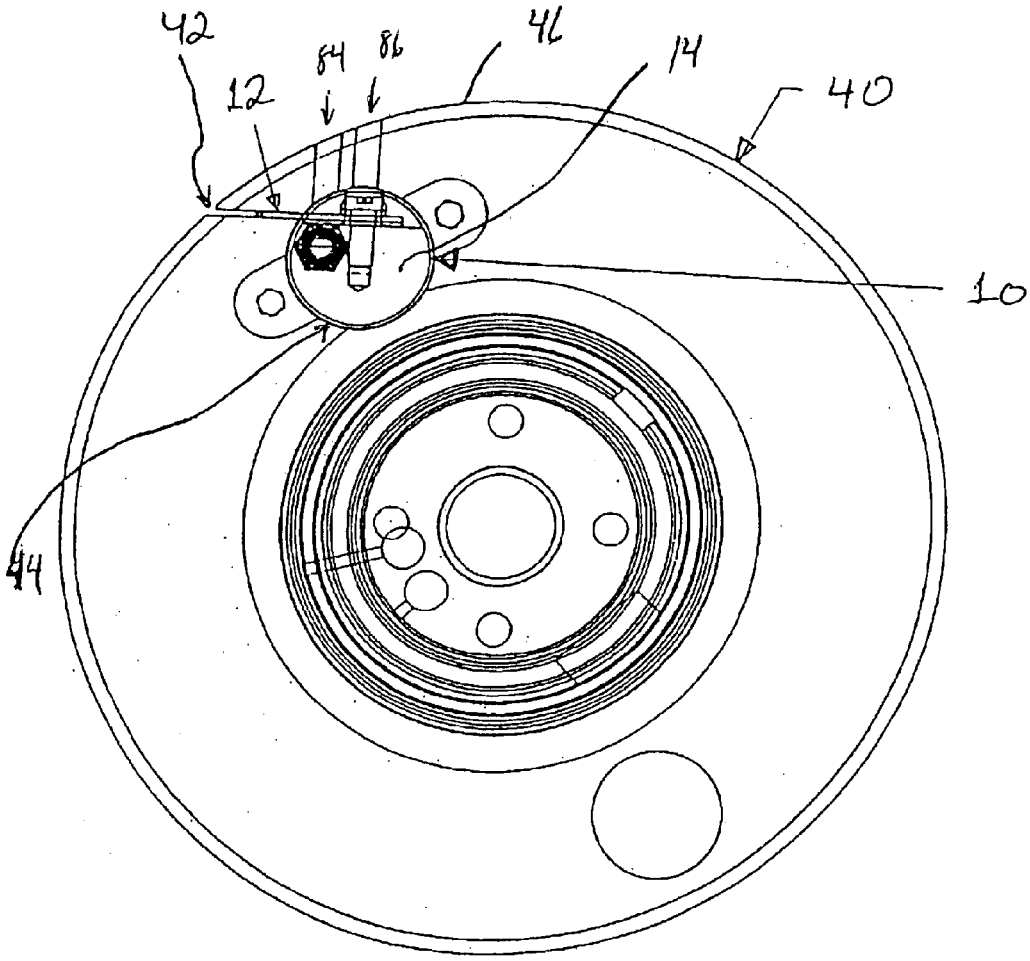
FIG. 2 shows a side view of a plate cylinder according to the present invention with the register device of FIG. 1 installed.

FIG. 2 shows the register device 10 installed in a channel 44 of plate cylinder 40. Pin support 14 fits in channel 44 so that pin support 14 can slide, but have little or no movement in a direction perpendicular to the axial direction. A slot 42 of the plate cylinder 40 extends between an outer surface 46 on which a printing plate is supported, and channel 44. Register pin 12 extends from the channel 44 into the slot 42. Register pin 12 thus can set the register for a printing plate, which has a notch as described in U.S. Pat. No. 6,439,117, the entire disclosure of which is hereby incorporated by reference herein.

Access holes 84, 86 may be provided at an end of the cylinder 40 to provide access to fixing devices 36, 34.

Figure 3:
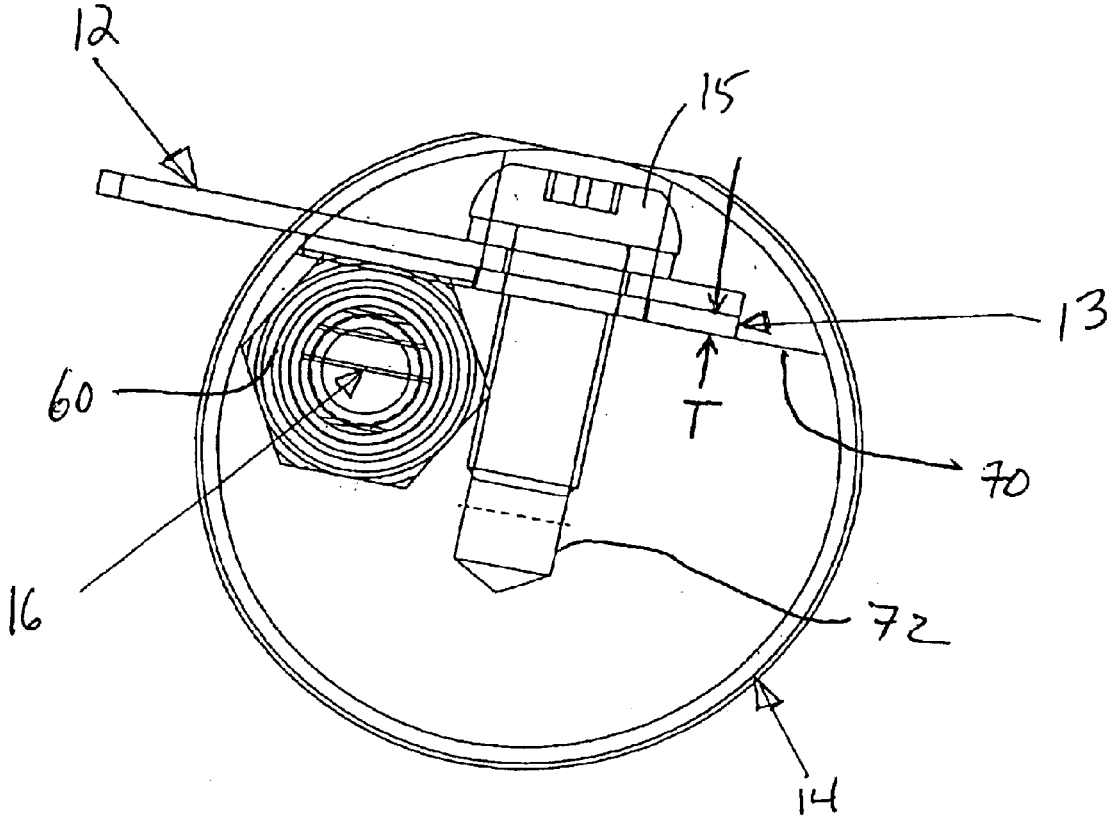
FIG. 3 shows a side view of one of the pin supports of the FIG. 1 device.

FIG. 3 shows a side view of pin support 14 of the FIG. 1 device. Register pin 12 is fastened via a connector 15, for example an Allen-head screw, to pin support 14. Connector 15 enters a hole 72 perpendicular to a planar surface 70 of pin support 14. If during installation, an operator determines that register pin 12 is not fitting well into the slot 42 (FIG. 2), for example, the register pin 12 is bending and creating friction which impedes axial sliding of pin support 14, the operator may remove the pin support 14 and provide a shim 13 between planar surface 70 and register pin 12. Shims 13 may be made of plastic, and may be provided in varying thicknesses T, for example 0.025 mm, 0.127 mm, 0.25 mm and 0.5 mm. The operator thus can select the thickness T which permits register pin 12 to slide well in slot 42. Planar surface 70 thus can be manufactured so as to be below slot 42 when co-planar with slot 42, but need not be manufactured to perfect precision as the shims can compensate for deviance.

Figure 4A:
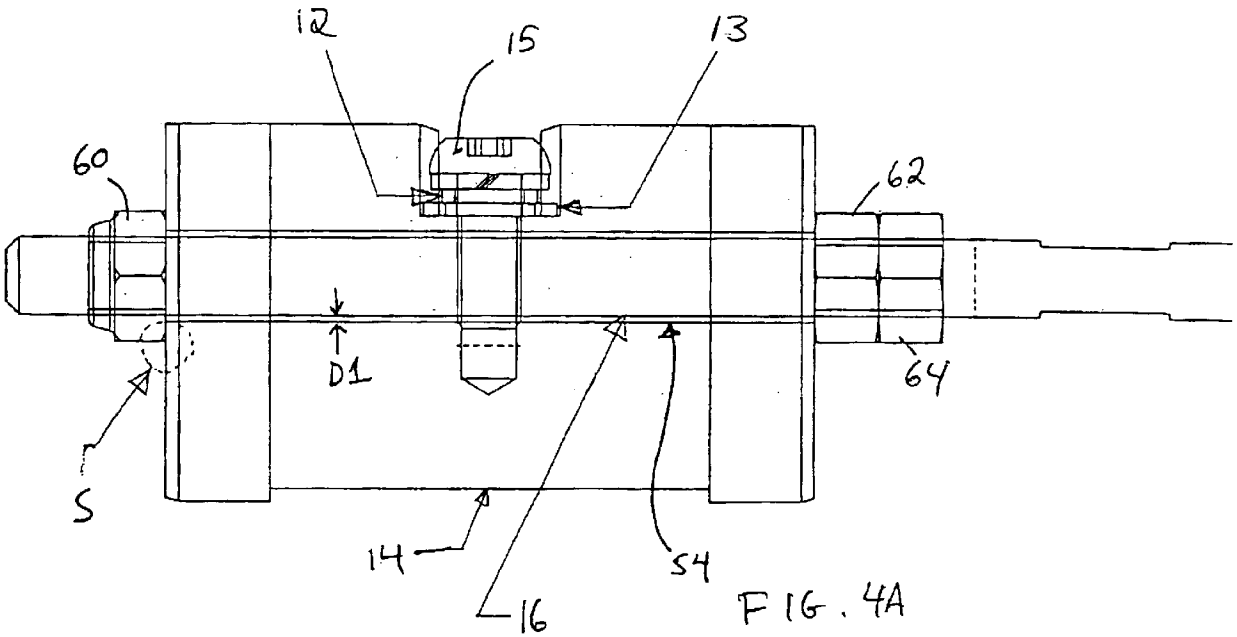
FIG. 4A shows a lateral view of one of the pin supports of the FIG. 1 device.
Figure 4B:
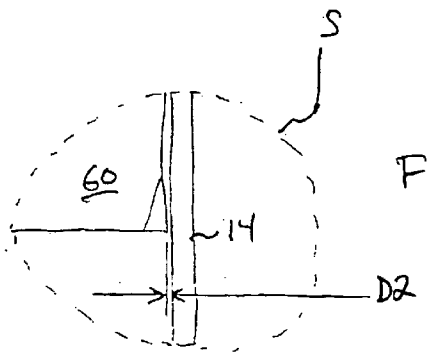
FIG. 4B shows more detail from section S of FIG. 4B.

FIG. 4A shows a lateral view of pin support 16 of the FIG. 1 device. As shown, pin support 14 has a hole 54, whose inner circumference has a greater diameter than the outer diameter of the outer circumference of rod 16. Thus a clearance D1 results between the rod 16 and the pin support 14, which during installation of device 10 provides for movement of rod 16 in a direction perpendicular to the axial direction. In order to permit this movement with the embodiment shown, nuts 60, 62 may be spaced so that a slight clearance D2, as shown in FIG. 4B, is provided in the axial direction. Nut 62 is in direct contact with pin support 14 in this view, so the entire clearance D2 is between nut 60 and pin support 14. This clearance D2 however is small enough so as not to alter print quality or lateral registration, and is for example preferably 0.1 mm or less, depending on the type of print job. Thus, while pin 12, support 14 and rod 16 generally move axially together to set the register, there can be a slight axial movement which does not affect print quality.

It should be noted that while the preferred embodiment is shown with clearances D1, D2 permitting movement of rod 16 with respect to the pin support 14 in the direction perpendicular to the axial direction, other devices or configurations attaching pin support 14 to rod 16 may be provided to permit rod 16 to move perpendicularly with respect to pin support 14.

It should also be noted that pin support 24 may also float with respect to rods 16 and 26, in a similar manner.

Figure 5:
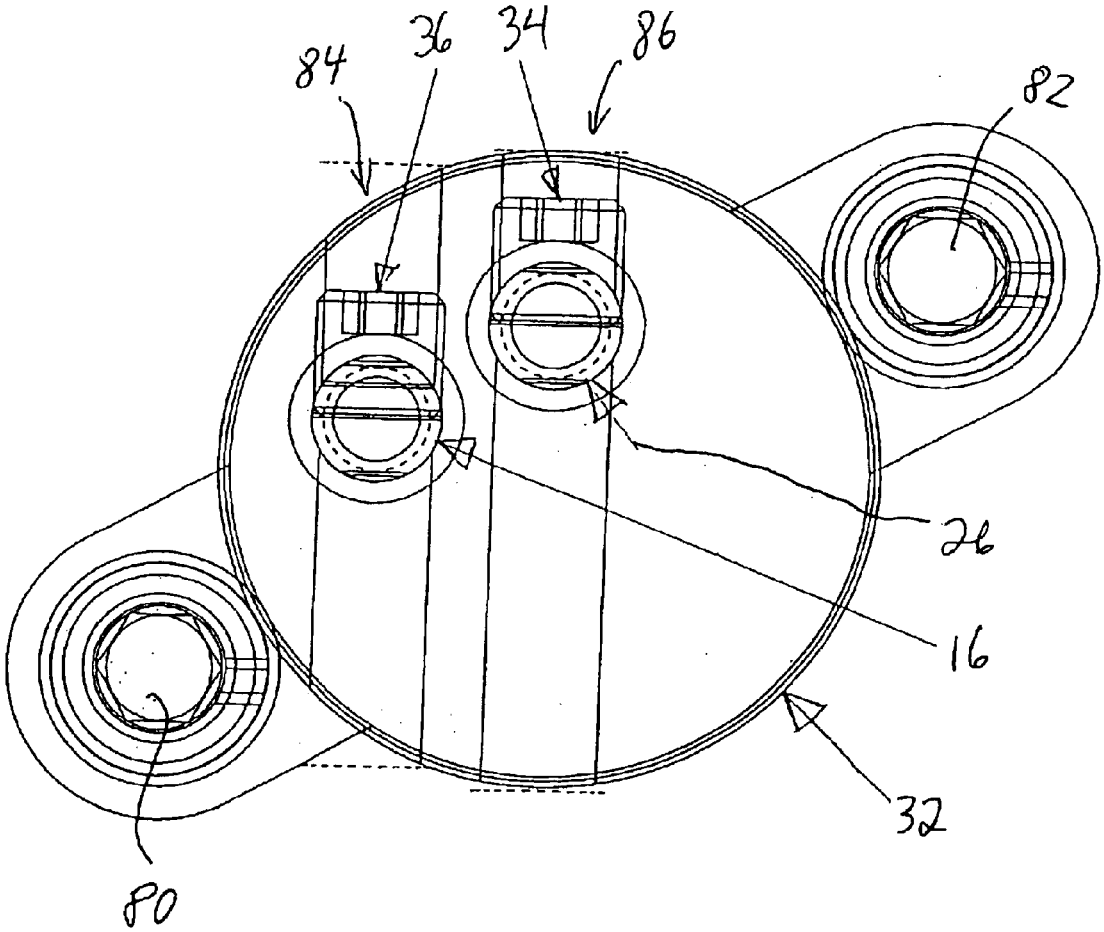
FIG. 5 shows an end view of the FIG. 1 device.

FIG. 5 shows an end view of the FIG. 1 device. Once device 10 is installed in channel 44 (FIG. 2), it may be fastened by bolts 80, 82 of end cap 32 to the plate cylinder. Access holes 84, 86 in cylinder 40 (FIG. 2) permit the operator to loosen and fasten fixing devices 36, 34, which fix rods 16 and 26, respectively. Fixing devices 36, 34 may for example be set screws which act directly on the ends of rods 16, 26.

While a two register pin device 10 has been shown, a device 10 with any number pins is possible.

What is claimed is:

1. A register device for insertion into a channel of a printing unit cylinder, the device comprising:

a rod defining an axial direction;

a pin support movable in the axial direction by the rod, the rod being movable with respect to the pin support in a direction perpendicular to the axial direction; and a register pin attached to the pin support.

2. The register device as recited in claim 1 wherein the pin support is adjustable relative to the rod in the axial direction along at least a part of the rod.

3. The register device as recited in claim 1 wherein a length of the rod is adjustable.

4. The register device as recited in claim 1 wherein the pin support has a hole, and the pin support receiving the rod with a clearance in the hole.

5. The register device as recited in claim 4 wherein the hole is located eccentrically on the pin support.

6. The register device as recited in claim 1 further comprising a second rod, a second pin support, the second rod being movable with respect to the second pin support in a direction perpendicular to the axial direction, and a second register pin attached to the second pin support, the second rod being adjustable in the axial direction so as to move the second register pin in the axial direction.

7. The register device as recited in claim 6 wherein the second rod passes through the pin support.

8. The register device as recited in claim 1 wherein the pin support is attached to the rod so that the pin support can move in the axial direction with respect to the rod by a movement amount, the movement amount being less than 0.1 millimeters.

9. The register device as recited in claim 1 further comprising a fixing device for fixing a position of the rod along the axial direction.

10. The register device as recited in claim 9 wherein the fixing device is at an end of the rod.

11. The register device as recited in claim 1 further comprising a replaceable shim located between the pin support and the register pin.

12. The register device as recited in claim 1 wherein the register pin is fixed with respect to the pin support in the axial direction.

13. A register device for insertion into a channel of a printing unit cylinder, the device comprising:

a rod defining an axial direction;

a pin support movable in the axial direction by the rod;

a shim replaceably connected to the pin support; and a register pin supported on the shim.

14. The register device as recited in claim 13 wherein the rod is movable with respect to the pin support in a direction perpendicular to the pin support.

15. The register device as recited in claim 13 wherein the pin support has a planar surface, the shim being coplanar with the planar surface, the register pin being coplanar with the planar surface and extending beyond an outer periphery of the pin support.

16. A plate cylinder for carrying at least one printing plate, the plate cylinder comprising:

a cylinder body defining an axial direction, the cylinder body having an outer surface, a channel extending in the axial direction and a slot extending in the axial direction, the slot extending from the channel to the outer surface; and a register device for adjusting axial registration of the at least one printing plate with respect to the cylinder body, the register device including a rod in the channel extending in the axial direction, a pin support movable in the channel in the axial direction by the rod, the rod being movable with respect to the pin support in a direction perpendicular to the axial direction, and a register pin attached to the pin support, the register pin extending into the slot.

17. A plate cylinder for carrying at least one printing plate, the plate cylinder comprising:

a cylinder body defining an axial direction, the cylinder body having an outer surface, a channel extending in the axial direction and a slot extending in the axial direction, the slot extending from the channel to the outer surface; and a register device for adjusting axial registration of the at least one printing plate with respect to the cylinder body, the register device including a rod in the channel extending in the axial direction, a pin support movable in the channel in the axial direction by the rod, a shim replaceably connected to the pin support, and a register pin supported on the shim and extending into the slot.

18. A method for adjusting the axial registration of a printing plate with respect to a plate cylinder, the method comprising the steps of:

moving a register pin support in an axial direction using a rod to adjust the axial location of a register pin attached to the pin support; and permitting the rod to move with respect to the register pin support in a direction perpendicular to the axial direction while the register pin support is moved in the axial direction.

19. The method as recited in claim 18 further comprising providing, prior to the moving step, a course adjustment of an axial position of the register pin with respect to the plate cylinder.

20. The method as recited in claim 19 wherein the coarse adjustment includes selection of a length of the rod.

21. The method as recited in claim 19 wherein the coarse adjustment is provided by changing an axial position of the register pin support on the rod.

22. A method for installing a register device in a channel and a slot of a printing unit cylinder comprising the steps of:

placing a pin support having a register pin in the channel so that the register pin extends into the slot;

determining if the pin support and the register pin slide axially in the channel; and if the pin support and register pin do not slide axially in the channel, placing a shim between the register pin and the pin support.

23. The method as recited in claim 22 wherein a previous shim is located on the pin support during the placing of the pin support step and the placing of the shim replaces the previous shim.

24. The method as recited in claim 22 wherein the pin support is movable axially by a rod, the rod being movable with respect to the rod in a direction perpendicular to the axial direction.

* * * * *